United States Patent [19]

Iorlano

[11] Patent Number: 4,892,315

[45] Date of Patent: Jan. 9, 1990

[54] GOLF HAND PAD DEVICE

[76] Inventor: Alfred Iorlano, 3106 Grove Rd., Palm Beach Gardens, Fla. 33410

[21] Appl. No.: 228,162

[22] Filed: Aug. 4, 1988

[51] Int. Cl.[4] ..... A63B 53/14; A41D 19/00

[52] U.S. Cl. ..... 273/166; 273/81 D; 273/DIG. 30; 2/161 A; 2/20

[58] Field of Search ..... 273/166, 81 D, 165, 273/81 R, 81.4, 24, DIG. 30, 26 C, 75, 28, 54 B; 43/18.1, 25; 2/16, 21, 161 A, 160, 163; 294/25; 81/489, 487, DIG. 1; 16/125, 127, DIG. 41, 113

[56] References Cited

U.S. PATENT DOCUMENTS

| | | | |
|---|---|---|---|
| 1,587,287 | 1/1926 | Denman | 273/165 |
| 2,710,190 | 6/1955 | Schimansky | 273/81.4 |
| 2,928,678 | 3/1960 | Cutting | 273/165 |
| 3,091,455 | 7/1963 | DeMire | 273/54 B |
| 3,217,332 | 11/1965 | Gross | 273/54 B |
| 3,863,271 | 2/1975 | Moroney | 2/161 A |

FOREIGN PATENT DOCUMENTS

| | | | |
|---|---|---|---|
| 322512 | 6/1929 | United Kingdom | 273/165 |

OTHER PUBLICATIONS

*Tommy Bolt's Super Grip,* Golf World, Aug. 26, 1977, p. 25.

*Primary Examiner*—Edward M. Coven
*Assistant Examiner*—Sebastiano Passaniti
*Attorney, Agent, or Firm*—Jack N. McCarthy

[57] ABSTRACT

A golf hand pad device has a hand pad for positioning in a golfer's hand adjacent the base of the small finger. The hand pad has an elongated groove for receiving the grip portion of a golf club shaft; an attachment positions and maintains the hand pad on the hand. In one embodiment, this attachment is a resilient ring fixed to the hand pad, which slips over the golfer's small finger of his upper hand for a golf swing. The hand pad includes a rounded portion for contacting the hand at the bottom of the little finger with a groove positioned at an angle thereto which receives the golf club shaft.

11 Claims, 2 Drawing Sheets

GOLF HAND PAD DEVICE

DESCRIPTION

1. Technical Field

This invention relates to a contoured golf hand pad device to be placed on the upper hand of a golf club hand grip and used as an aid in gripping a golf club in a firm grip. It is especially useful in positioning the golf club in one's hand for what is known as the finger tip grip.

2. Background Art

In the past, an aid for gripping a golf club has been a plain golf glove, used on the upper hand. Some golfers use resin between the golf club shaft grip and one's hand, with or without a gove. Golf rules also state that a towel, gauze, or a handkerchief can be wrapped around the golf club grip for better gripping.

3. Disclosure of Invention

One object of the present invention is to provide an upper hand positioning pad which is helpful in obtaining a firm grip on the grip portion of the shaft of the golf club.

Another object of the invention is to provide a golf hand pad to be used to help in learning the finger tip grip which helps maintain a straight line with the upper hand, wrist, and forearms on the back swing.

A further object of the invention is to provide a golf hand pad for the upper hand which tends to eliminate "sloppy movement" between the small finger and the golf club shaft at the top of the back swing. This is especially helpful for the novice and older golfer.

Another object of the invention is to provide an attachment for positioning a golf hand pad in said hand for proper use. The attachment can be a resilient ring; for example, a ring made of rubber, on said pad for placement over a finger which will provide limited movement of the hand pad to achieve the proper positioning. The hand pad can also have a piece of velcro material attached instead of a resilient ring and a golf glove can have a mating adhering velcro material thereon so that the hand pad can be fixedly placed in a proper position thereon. Velcro attachments are well known.

BEST MODE FOR CARRYING OUT THE INVENTION

Figure 2:
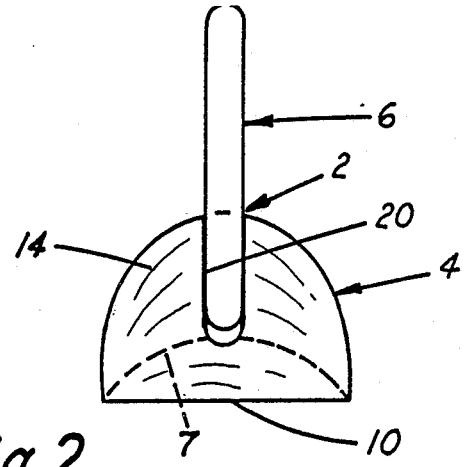
FIG. 2 is a front end view of FIG. 1 showing the golf hand pad and resilient positioning ring.
Figure 1:
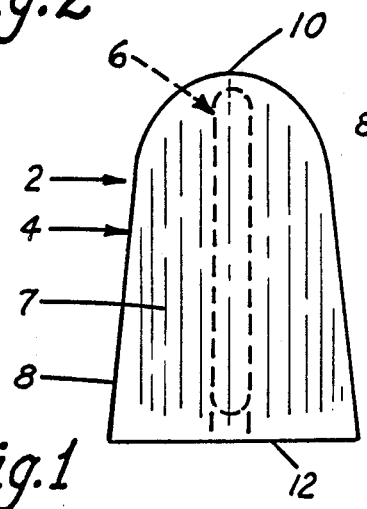
FIG. 1 is a top view of the golf hand pad device showing the groove for receiving a grip portion of a golf club shaft.
Figure 4:
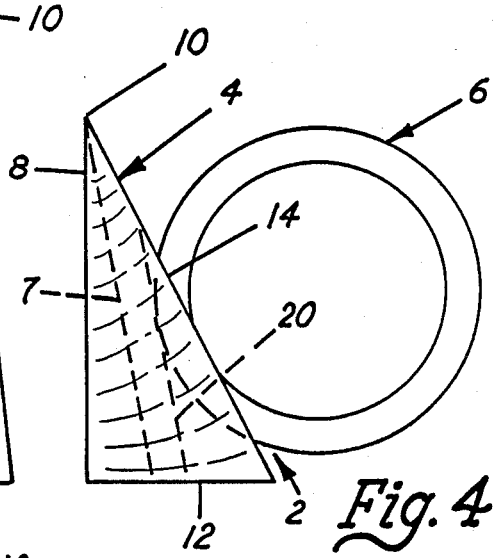
FIG. 4 is a side view of FIG. 1 showing the tapered body of the golf hand pad and resilient positioning ring fixed thereto.
Figure 3:
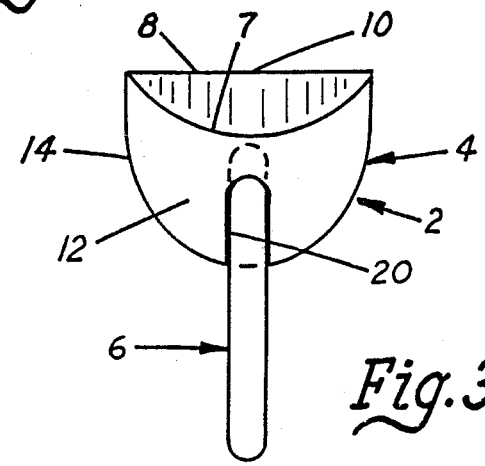
FIG. 3 is a rear end view of FIG. 1 showing the end of the groove of the golf hand pad and the resilient positioning ring.

As illustrated in the drawings, a golf hand pad device 2 is shown formed having a golf hand pad 4 and a positioning resilient ring 6. The golf hand pad 4 is constructed having a groove 7 forming its top surface and extending from a forward point 10 to a rear surface 12. Groove 7 tapers downwardly from forward point 10 to where it intersects the rear surface 12 of the golf hand pad 4. The side edges 8 of the groove 7 extend in straight lines and curve inwardly to meet the forward point 10 of the groove 7. The groove 7 is sized to cooperate with the mating portion of the golf shaft to aid in the gripping and positioning of the golf club. The bottom surface 14 of the golf hand pad 4 tapers downwardly from forward point 10 to where it intersects the rear surface 12 (see FIG. 4), and the bottom surface 14 is rounded as it extends between the top edges 8 from rear surface 12 along its length up to forward point 10. It is this tapered rounded surface 14 which engages the golfer's hand adjacent the little finger 16. As this tapered rounded surface 14 engages the golfer's hand, the groove 7 aligns with the grasp of the remaining three fingers to obtain a firmer grip. Hand pad 4 helps to provide a firmer grip between the small finger and the shaft.

Figure 5:
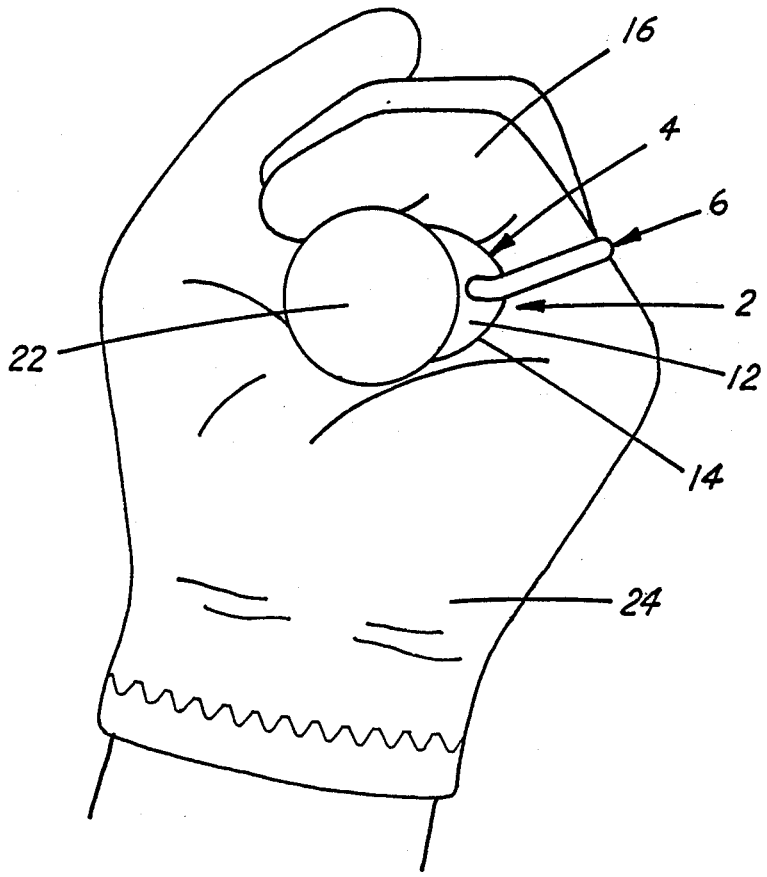
FIG. 5 is a view from the upper end of a golf club as it is held by a gloved left hand of a right-hand golfer, with a golf hand pad in place using a resilient positioning ring.

To position the golf hand pad 4 properly, a resilient ring 6 is fixed to the bottom surface 14 of the golf hand pad 4 so that it can be slipped over the little finger 16 of the proper upper hand for either a right-handed or left-handed golfer (see FIG. 5). The top of a golf club is shown at 22 in FIG. 5 and a golf glove 24 is shown. While the resilient ring 6 can be connected to the golf hand pad 4 in many ways, in a modification built, a small groove 20 was placed in the bottom surface 14 at the center thereof below the groove 7 having a width approximately equal to the width of the resilient ring 6. The resilient ring 6 was positioned in the groove 20 and bonded thereto by an adhesive. It is to be understood that the ring can be fixed in place by other means well known in the art. For custom made devices 2, the resilient ring 6 can be moved along the length of the groove 20 and fixed at any desired spot, depending on the size and contour of one's hand.

Another means for positioning the golf hand pad 4 with respect to one's hand is to use a golf glove having a piece of velcro material attached to the glove where a hand pad 4 is desired; then a hand pad 4 having a mating adhering velcro material thereon in place of the resilient ring 6 has the mating velcro material placed against the velcro material of the golf club. This arrangement places the hand pad 4 in position for use.

In the modification built, the hand pad 4 and resilient ring 6 were made of a firm rubber having limited flexibility. This permitted a groove 7 to accommodate grips of golf club shafts having slightly different diameters; said hand pad 4 and resilient ring 6 holding their form unless forced in a different position by use, such as the ring 6 in FIG. 5.

I claim:

1. A golf hand pad device comprising a tapered hand pad for positioning on a golfer's upper hand adjacent the base of the little finger, said tapered hand pad having an elongated groove tapered along its length for receiving the grip portion on a golf club shaft, means for positioning and maintaining said tapered hand pad on a golfer's upper hand.

2. A golf hand pad device as set forth in claim 1 wherein said elongated groove is the entire top of said tapered hand pad, said elongated groove having side edges, the entire bottom of said hand pad is rounded from one side edge of said groove to the other side edge of said groove and extends lengthwise below said groove at an angle to said groove for resting in and contacting the juncture of said little finger and the adjacent part of a golfer's upper hand, when said tapered hand pad is positioned on a golfer's upper hand said elongated groove is aligned with the grasp of the remaining three fingers of a golfer's upper hand to receive a grip portion on a golf club shaft.

3. A golf hand pad device as set forth in claim 1 wherein said elongated groove is the entire top of the tapered hand pad, said tapered hand pad having a rear surface extending downwardly from said elongated groove to a lower edge and having a front edge, said hand pad having a bottom portion extending at an angle to said elongated groove from said front edge to the lower edge of said rear surface, said bottom portion being rounded for fitting into a golfer's upper hand so that a little finger can extend around the hand pad and grip a golf club shaft to tend to eliminate movement between the little finger and the golf club shaft at the top of the back swing.

4. A golf hand pad device as set forth in claim 1 wherein said means for positioning and maintaining said hand pad on a golfer's upper hand is a ring fixed to said hand pad for receiving a little finger.

5. A golf hand pad device as set forth in claim 4 wherein said elongated groove is on one side of said tapered hand pad and said ring is on the other side.

6. A golf hand pad device as set forth in claim 4 wherein said ring is resilient.

7. A golf hand pad device comprising a hand pad for positioning on a golfer's upper hand adjacent the base of the little finger, said hand pad having an elongated groove for receiving the top of the grip portion on a golf club shaft, said groove having side edges, said groove having a front end and a rear end, means for positioning and maintaining said hand pad on a golfer's upper hand, said groove being the entire top of said hand pad, the bottom of said hand pad being rounded below said groove connecting said side edges of said groove for resting in and contacting the juncture of said little finger and the adjacent part of the hand, said rounded bottom having a front end and a rear end, said elongated groove being aligned with the grasp of the remaining three fingers of a golfer's upperr hand to receive the grip portion on a golf club shaft, said hand pad having a rear surface extending between the rear end of the groove at the top of the hand pad to the rear end of the rounded bottom of the hand pad, said hand pad having a front edge formed by the front end of the groove at the top of the hand pad and the front end of the rounded bottom of the hand pad, said hand pad being tapered from said front edge to said rear surface between said elongated groove and rounded bottom.

8. A golf hand pad as set forth in claim 7 wherein said means for positioning and maintaining said hand pad on a golfer's upper hand comprises a ring fixed to the rounded bottom of the hand pad, said ring extending below the rounded bottom to receive a little finger when the rounded bottom is resting in and contacting the juncture of a little finger and the adjacent part of a golfer's upper hand.

9. A golf hand pad as set forth in claim 7 wherein said means for positioning and maintaining said hand pad on a golfer's upper hand comprises a holding groove located in the rounded bottom of the hand pad along the length of the hand pad, a ring is positioned with one edge fixed in said holding groove, said ring presenting an opening for receiving a little finger.

10. A golf hand pad device comprising a tapered hand pad having a front edge and a rear surface for positioning on a golfer's upper hand adjacent the base of the little finger, said rear surface having a top and bottom, said tapered hand pad having an upper elongated groove extending for the length of the pad from the front edge to the top of the rear surface for receiving the top of the grip portion on a golf club shaft, said groove being the entire top of said tapered hand pad, said tapered hand pad having a lower rounded surface extending for the length of the pad from the front edge to the bottom of the rear surface for resting in and contacting the juncture of said little finger and the adjacent part of the hand, said rounded surface being the entire bottom of said tapered hand pad, means for positioning and maintaining said tapered hand pad on a golfer's upperr hand, the front edge of said elongated groove being aligned with the grasp of the remaining three fingers of a golfer's upper hand when the hand pad is positioned thereon, said rear surface extending between the groove at the top of the hand pad to the rounded surface at the bottom of the hand pad, said lower rounded surface of said tapered hand pad being rounded so that a little finger can extend around the tapered hand pad to provide a firmer grip on the top of the grip portion on a golf club shaft.

11. A golf hand pad as set forth in claim 10 wherein said means for positioning and maintaining said tapered hand pad on a golfer's upper hand comprises a ring fixed to the lower rounded surface of the tapered hand pad, said ring extending below the lower rounded surface to receive a finger when the rounded bottom is resting in and contacting the juncture of a little finger and the adjacent part of a golfer's upper hand.

* * * * *